US009090422B2

(12) United States Patent
Horikawa

(10) Patent No.: US 9,090,422 B2
(45) Date of Patent: Jul. 28, 2015

(54) RECORDING DEVICE WITH PAPER ROLL COMPARTMENTS

(75) Inventor: Hideshi Horikawa, Kyoto (JP)

(73) Assignee: Seiko Epson Corporation, Tokyo (JP)

( * ) Notice: Subject to any disclaimer, the term of this patent is extended or adjusted under 35 U.S.C. 154(b) by 576 days.

(21) Appl. No.: 13/008,996

(22) Filed: Jan. 19, 2011

(65) Prior Publication Data

US 2011/0192930 A1 Aug. 11, 2011

(30) Foreign Application Priority Data

Feb. 8, 2010 (JP) ..... 2010-025282

(51) Int. Cl.
*B41J 11/48* (2006.01)
*B65H 19/12* (2006.01)

(52) U.S. Cl.
CPC ..... *B65H 19/126* (2013.01); *B65H 2402/31* (2013.01); *B65H 2402/32* (2013.01); *B65H 2405/43* (2013.01); *B65H 2801/12* (2013.01)

(58) Field of Classification Search
CPC ..... B41J 15/04; B41J 15/042; B41J 15/044; B41J 15/18; B41J 15/22; B65H 16/021; B65H 16/023; B65H 16/10
USPC ..... 400/613, 609; 242/560
See application file for complete search history.

(56) References Cited

U.S. PATENT DOCUMENTS

| | | | | |
|---|---|---|---|---|
| 6,343,884 | B1 * | 2/2002 | Watanabe et al. | 400/621 |
| 7,125,181 | B2 * | 10/2006 | Takabatake et al. | 400/605 |
| 2003/0016975 | A1 * | 1/2003 | Kojima | 399/384 |
| 2005/0207813 | A1 | 9/2005 | Takabatake et al. | |
| 2006/0221171 | A1 * | 10/2006 | Watanabe et al. | 347/215 |
| 2007/0063086 | A1 * | 3/2007 | Itoh et al. | 242/348.4 |
| 2007/0262141 | A1 * | 11/2007 | Ito et al. | 235/383 |

FOREIGN PATENT DOCUMENTS

| | | | |
|---|---|---|---|
| JP | 06-021944 | U | 3/1994 |
| JP | 09-249341 | A | 9/1997 |
| JP | 09-263015 | A | 10/1997 |
| JP | 10-157886 | A | 6/1998 |
| JP | 2006-056655 | A | 3/2006 |
| JP | 2006-327806 | A | 12/2006 |

* cited by examiner

*Primary Examiner* — Blake A Tankersley
*Assistant Examiner* — Quang X Nguyen
(74) *Attorney, Agent, or Firm* — Global IP Counselors, LLP

(57) ABSTRACT

A recording device includes a recording head for recording on a sheet; a first paper roll accommodating part for accommodating the first paper roll; a second paper roll accommodating part for accommodating the second paper roll; and a conveyance mechanism for conveying a sheet unwound from the first paper roll or a sheet unwound from the second paper roll to the recording head. The first paper roll accommodating part is provided inside the device body and is capable of being pulled to the outside of the device body by being slid in relation to the device body; and the second paper roll accommodating part is provided outside the device body, and can be rotated in relation to the device body.

6 Claims, 6 Drawing Sheets

11
12
13
13a
13b
14
15
16
17
18
19
31
32
33
33a
33d
34
RP1
RP2
ST
UP
REAR

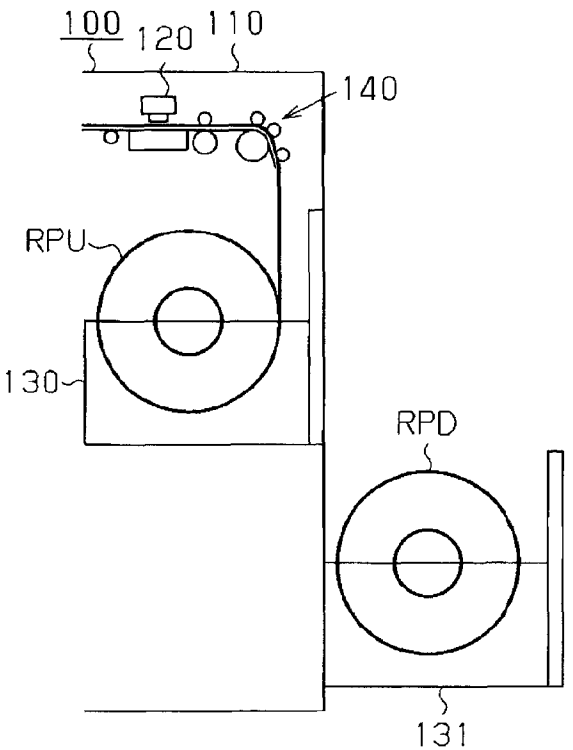
Fig. 6C (Prior Art)
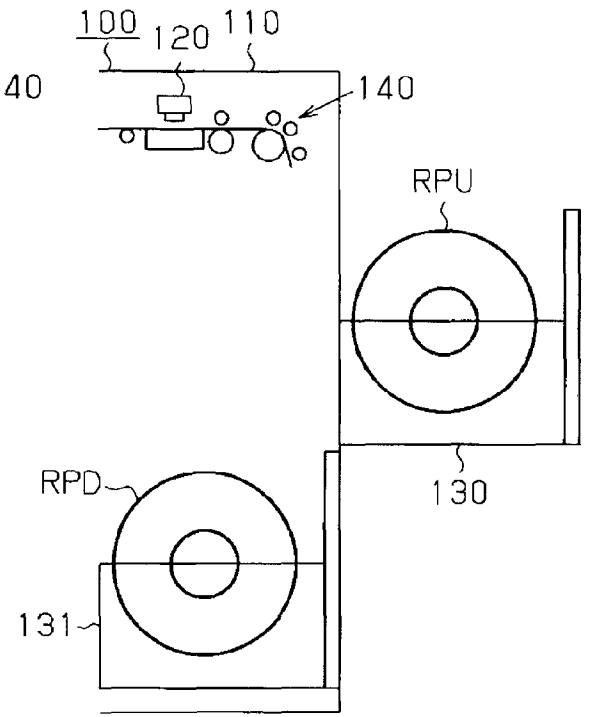
Fig. 6B (Prior Art)
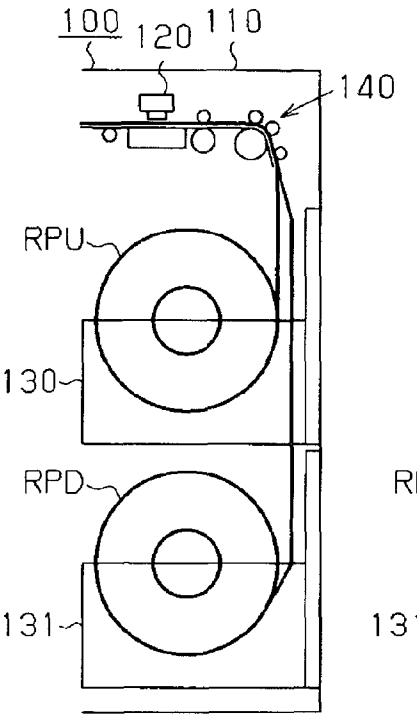
Fig. 6A (Prior Art)
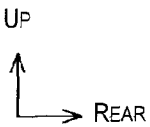

RECORDING DEVICE WITH PAPER ROLL COMPARTMENTS

CROSS-REFERENCE TO RELATED APPLICATIONS

This application claims priority to Japanese Patent Application No. 2010-025282 filed on Feb. 8, 2010. The entire disclosure of Japanese Patent Application No. 2010-025282 is hereby incorporated herein by reference.

BACKGROUND

1. Technical Field

The present invention relates to a recording device for recording images or characters on a sheet through the use of a recording head.

2. Related Art

Known conventional recording devices are provided with a paper roll accommodating part for accommodating a paper roll in which a long sheet is wound over itself into a roll, a conveyance mechanism for conveying a portion of the sheet unwound from the paper roll, and a recording head for applying a recording process to the conveyed sheet. In a known example of such a recording device, a plurality of paper roll accommodating parts is provided to accommodate each of a plurality of paper rolls in the recording device (see Japanese Laid-Open Patent Publication No. 2006-56655, for example).

The configuration of a recording device having a plurality of paper roll accommodating parts will be described with reference to FIG. 6.

As shown in FIG. 6A, a recording device 100 is provided with a device body 110 which constitutes a chassis. A recording head 120 and an upper paper roll accommodating part 130 and lower paper roll accommodating part 131 arranged in the up-down direction and capable of being pulled out by sliding in relation to the device body 110 are provided inside the device body 110. The device body 110 is also provided with a conveyance mechanism 140 for conveying a sheet of an upper paper roll RPU accommodated in the upper paper roll accommodating part 130 and a sheet of a lower paper roll RPD accommodated in the lower paper roll accommodating part 131 each toward the recording head 120.

In such a recording device 100, a paper roll switching operation is performed in which the recording device 100 automatically switches from the upper paper roll RPU to the lower paper roll RPD. A paper roll replacement operation is also performed in the recording device 100, in which the upper paper roll RPU or the lower paper roll RPD is replaced by a user.

SUMMARY

In the recording device 100 described above, in the case of the switching operation or paper roll replacement operation, the sheet conveyed to the recording head 120 from the upper paper roll RPU or the lower paper roll RPD is rewound, as shown in FIG. 6B.

In the state in which the sheet is rewound, since the upper paper roll accommodating part 130 and the lower paper roll accommodating part 131 are capable of being pulled to the outside of the device body 110, it is possible to replace the upper paper roll RPU and the lower paper roll RPD, as shown in FIGS. 6B and 6C.

After the switching operation or paper roll replacement operation described above, a sheet is unwound from the upper paper roll RPU or the lower paper roll RPD toward the recording head 120 via the conveyance mechanism 140.

In the recording device 100, since the upper paper roll accommodating part 130 and the lower paper roll accommodating part 131 are both provided inside the device body 110, the lower paper roll accommodating part 131 must be provided in a position far away from the recording head 120.

The sheet is therefore prone to become misaligned in the sheet width direction, i.e., the rotational axis direction of the roll, when the sheet is conveyed by the conveyance mechanism 140. More time is also taken for the sheet to be rewound onto the lower paper roll RPD, and for the sheet to be unwound from the lower paper roll RPD, and a longer time is required for the paper roll switching operation or the paper roll replacement operation.

The present invention was developed in view of such problems and an object of the present invention is to provide a recording device provided with a plurality of paper roll accommodating parts, whereby reductions in the precision of conveyance of the paper roll sheet can be suppressed, and the time taken to switch or replace the paper rolls can be reduced.

In order to achieve the abovementioned objects, a recording device according to a first aspect of the present invention includes a device body, a recording head, a first paper roll accommodating part, a second paper roll accommodating part, and a conveyance mechanism. The device body forms a chassis. The recording head is configured to record on a sheet unwound from a first paper roll or a second paper roll. The recording head is provided inside the device body. The first paper roll accommodating part is configured to accommodate the first paper roll. The second paper roll accommodating part is configured to accommodate the second paper roll. The conveyance mechanism is configured to convey a sheet unwound from the first paper roll or a sheet unwound from the second paper roll to the recording head. The first paper roll accommodating part is provided inside the device body and configured to be pulled to the outside of the device body by being slid in relation to the device body. The second paper roll accommodating part is provided outside the device body and attached to the device body, and configured to be rotated in relation to the device body.

According to the first aspect, since the first paper roll accommodating part is provided inside the device body, and the second paper roll accommodating part is provided outside the device body and attached to the device body, the first paper roll accommodating part and the second paper roll accommodating part can be arranged so that the distance between the recording head and each of the first paper roll accommodating part and the second paper roll accommodating part is reduced. Reductions in the precision of conveyance of the plurality of paper rolls by the conveyance mechanism can thereby be suppressed, and the time taken to rewind the paper rolls during paper roll switching or paper roll replacement can be reduced.

In the recording device according to a second aspect, a first slide position at which the first paper roll accommodating part is accommodated inside the device body, and a second slide position at which the first paper roll accommodating part is pulled to the outside of the device body can be selected as the position of the first paper roll accommodating part with respect to the device body. A first rotation position at which the second paper roll accommodating part interferes with the first paper roll accommodating part when the first paper roll accommodating part is at the second slide position, and a second rotation position at which the second paper roll accommodating part does not interfere with the first paper roll accommodating part when the first paper roll accommodating part is at the second slide position can be selected as the position of the second paper roll accommodating part with respect to the device body.

According to this aspect, since the first rotation position of the second paper roll accommodating part interferes with the second slide position of the first paper roll accommodating part, the size of the recording device can be reduced relative to a configuration in which the second paper roll accommodating part is disposed so as to keep out of the way of the second slide position.

In the recording device according to a third aspect, a top end part of the second paper roll accommodating part is preferably at the same height as a top end part of the device body or is positioned lower than the top end part of the device body when the second paper roll accommodating part is at the first rotation position.

In this aspect, in a state in which the second paper roll accommodating part is at the first rotation position, the top end part of the second paper roll accommodating part is at the same place as a top end part of the device body or positioned lower than the top end part of the device body. The size of the recording device in the up-down direction can thereby be reduced relative to a configuration in which the second paper roll accommodating part protrudes upward past the top end part of the device body.

In the recording device according to a fourth aspect, a rotation shaft for causing the second paper roll accommodating part to rotate is preferably attached to the device body. The second paper roll accommodating part preferably includes a receiving part for receiving the second paper roll, and a lid part covering an open side of the receiving part and thereby accommodating the second paper roll in cooperation with the receiving part; and each of the receiving part and the lid part is attached to, and rotates about, the rotation shaft.

According to this aspect, since the receiving part and the lid part rotate about the same rotation shaft, the configuration of the second paper roll accommodating part can be simplified relative to a configuration in which a rotation shaft for rotating the receiving part and a rotation shaft for rotating the lid part are provided as separate members.

In the recording device according to a fifth aspect, the paper roll loading capacity of the second paper roll accommodating part is preferably smaller than the paper roll loading capacity of the first paper roll accommodating part.

According to this aspect, since the paper roll loading capacity of the second paper roll accommodating part is smaller than the paper roll loading capacity of the first paper roll accommodating part, a user can easily rotate the second paper roll accommodating part.

BRIEF DESCRIPTION OF THE DRAWINGS

Referring now to the attached drawings which form a part of this original disclosure:

FIGS. 6A through 6C are schematic sectional views showing a conventional recording device.

DETAILED DESCRIPTION OF EXEMPLARY EMBODIMENTS

First Embodiment

Figure 1A:
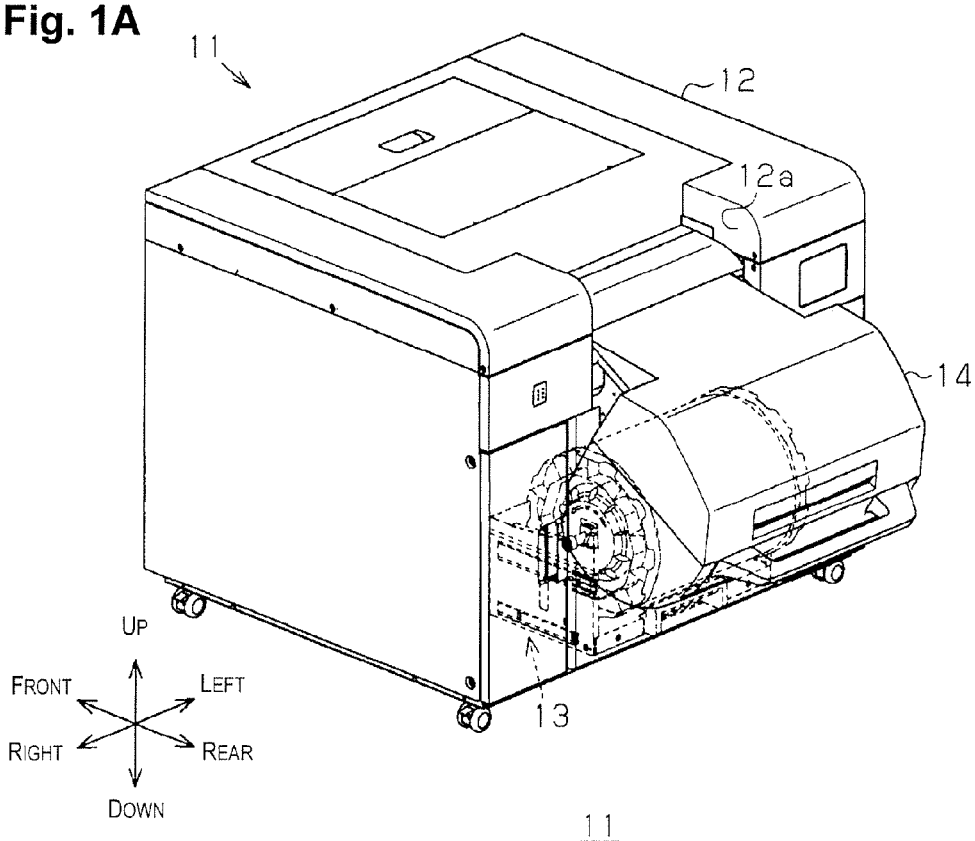
FIG. 1A is a perspective view showing the printer according to a first embodiment.

A first specific embodiment of the present invention will be described based on FIGS. 1 through 4. In the following description, "front-rear direction," "up-down direction," and "left-right direction" refer to the "front-rear direction," "up-down direction," and "left-right direction" indicated by arrows in FIG. 1, unless otherwise noted. In the present embodiment, the up-down direction is defined as being the same direction as the vertical direction.

As shown in FIG. 1, an inkjet printer (hereinafter referred to as "printer 11") as the recording device is configured so that a continuous paper or other long sheet is maintained in the state of a paper roll in which the sheet is wound over itself into a roll, and recording is applied to the sheet unwrapped from the paper roll. The printer 11 is provided with a rectangular box-shaped device body 12 which constitutes a chassis. The device body 12 is provided with a first paper roll accommodating part 13 for accommodating a first paper roll RP1, and a second paper roll accommodating part 14 for accommodating a second paper roll RP2. A flat plate-shaped door 12*b* for enabling the accommodating space of the first paper roll accommodating part 13 to be opened and closed is provided behind and below the device body 12.

The first paper roll accommodating part 13 is capable of accommodating a paper roll up to 12 inches in width, whereas the second paper roll accommodating part 14 is capable of accommodating a paper roll up to 8 inches in width. The first paper roll accommodating part 13 and the second paper roll accommodating part 14 are each formed so that the paper roll loading capacity of the second paper roll accommodating part 14 is smaller than the paper roll loading capacity of the first paper roll accommodating part 13.

The first paper roll accommodating part 13 is provided at the bottom of the inside of the device body 12, and is provided so as to be able to be pulled to the outside of the device body 12 by sliding in the front-rear direction. The position of the first paper roll accommodating part 13 in a state in which the first paper roll accommodating part 13 is accommodated inside the device body 12 is referred to as the "first slide position," and the position of the first paper roll accommodating part 13 in a state in which the first paper roll accommodating part 13 is pulled to the outside of the device body 12 is referred to as the "second slide position."

The lower portion of the first paper roll RP1 is accommodated in the first paper roll accommodating part 13, and a box-type accommodating body 13*a* which opens upward is also provided to the first paper roll accommodating part 13. The accommodating body 13*a* is provided with a rail for transferring the first paper roll RP1 to a support portion of a roll rotation shaft J for the first paper roll RP1, provided to the device body 12 on both sides in the left-right direction. A U-shaped handle part 13*b* extending to the rear is provided at the rear end of the accommodating body 13*a*.

The accommodating body 13*a* such as described above is provided with an accommodating body-side rail which fits with a body-side rail provided to the device body 12, and the accommodating body 13*a* thereby slides in the front-rear direction in relation to the device body 12.

The second paper roll accommodating part 14 is provided outside the device body 12 and attached to the device body 12. The second paper roll accommodating part 14 is also provided so as to be able to rotate in the up-down direction in relation to the device body 12. Specifically, a concave portion 12*a* for accommodating a portion of the second paper roll accommodating part 14 is provided at the top rear surface of the device body 12. A shaft 32 as a rotation shaft extending in the left-right direction is attached on the inside of the concave portion 12*a* at the top of the device body 12. The second paper roll accommodating part 14 is attached to the shaft 32, and the second paper roll accommodating part 14 thereby moves so as to be able to rotate about the shaft 32. The shaft 32 is also provided in the vicinity of a roller 23 and positioned above the roller 23.

In the state shown in FIG. 1A, the top end part of the second paper roll accommodating part 14 is disposed lower than the top end part of the device body 12. The bottom end part of the second paper roll accommodating part 14 is disposed lower than the top end part of the first paper roll accommodating part 13, i.e., the top end part of the first paper roll RP1, and higher than the bottom end part of the first paper roll accommodating part 13. In other words, the first paper roll accommodating part 13 and the second paper roll accommodating part 14 are disposed so as to overlap in the up-down direction as viewed from the front-rear direction. The position of the second paper roll accommodating part 14 such as described above is referred to hereinafter as the "first rotation position." In a state in which the second paper roll accommodating part 14 is at the first rotation position, the first paper roll accommodating part 13 and the second paper roll accommodating part 14 interfere with each other when the second paper roll accommodating part 14 is moved to the second slide position of the first paper roll accommodating part 13. Moreover, in a state in which the second paper roll accommodating part 14 is at the first rotation position, the second paper roll accommodating part 14 is at a position which also interferes with the opening and closing position of the door 12*b*.

Figure 1B:
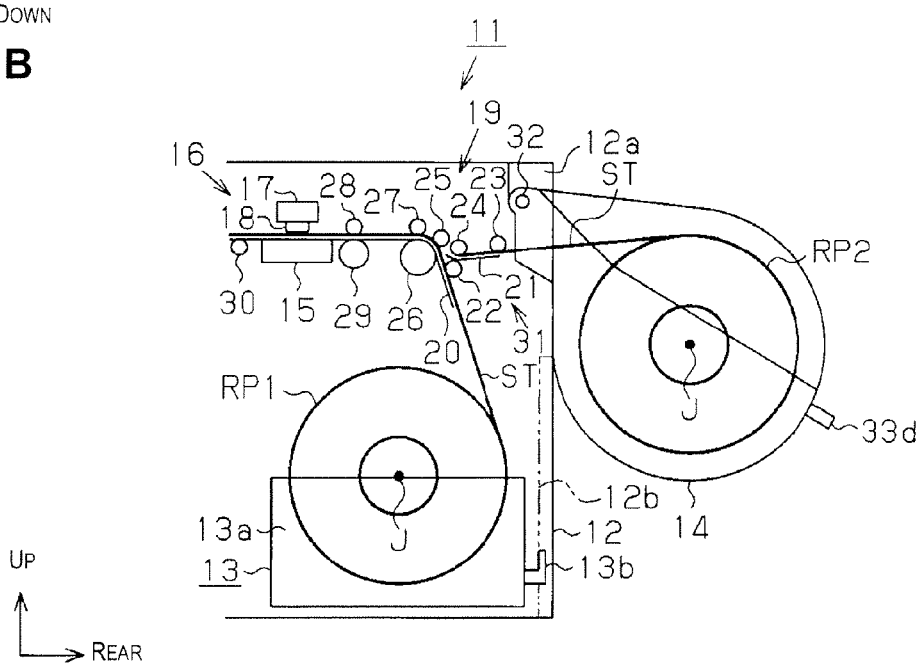
FIG. 1B is a rough structural view showing the printer in the state shown in FIG. 1A.

As shown in FIG. 1B, a rectangular plate-shaped platen 15 which is a support stage for supporting a sheet ST is mounted in a position above the first paper roll accommodating part 13 inside the device body 12. The upper region that includes the platen 15 forms a printing chamber 16 for applying a recording treatment by ejecting ink to the sheet ST.

A pair of guide rails extending in the left-right direction is provided on the left and right sides of the platen 15 inside the printing chamber 16. The guide rails are higher than the top surface of the platen 15. A rectangular carriage 17 is supported by the guide rails so as to be able to move reciprocally in the left-right direction along the guide rails on the basis of the driving of a drive mechanism not shown in the drawing. A recording head 18 is mounted on the bottom surface of the carriage 17.

A conveyance mechanism 19 for conveying the sheet ST toward the printing chamber 16 on a sheet ST conveyance path extending from the first paper roll accommodating part 13 and second paper roll accommodating part 14 to the printing chamber 16 is provided in the device body 12. The conveyance mechanism 19 is provided with a first receiving plate 20 for receiving the sheet ST of the first paper roll RP1, a second receiving plate 21 for receiving the sheet ST of the second paper roll RP2, and rollers 22 through 30 for conveying the sheet ST to the receiving plates 20, 21. The first receiving plate 20 is composed of a horizontal plate which extends to the rear from the printing chamber 16, and an inclined plate which extends toward the first paper roll RP1 from the rear end of the horizontal plate, i.e., downward and to the rear. The second receiving plate 21 is a flat plate which extends in the front-rear direction and is disposed to the rear of the rear end of the horizontal plate described above. In the conveyance mechanism 19 such as described above, the rollers 22 through 30 are rotated by a drive mechanism (not shown) provided to the printer 11, and the sheet ST of the first paper roll RP1 or the sheet ST of the second paper roll RP2 is thereby conveyed toward the printing chamber 16.

The printer 11 is formed so that the distance along the conveyance path from the first paper roll RP1 to the roller 22, and the distance along the conveyance path from the second paper roll RP2 to the roller 24 are substantially equal. The roller 22 and the roller 24 are disposed in the vicinity of each other.

The rollers 22 through 24 among the rollers 22 through 30 constitute a paper roll switching part 31 for switching between the conveyance path for conveying the sheet ST from the first paper roll RP1 to the printing chamber 16, and the conveyance path for conveying the sheet ST from the second paper roll RP2 to the printing chamber 16. During switching from the first paper roll RP1 to the second paper roll RP2 in this configuration, the sheet ST of the first paper roll RP1 is rewound from the printing chamber 16 to the first paper roll RP1, and the sheet ST of the second paper roll RP2 is unwound from the second paper roll RP2 to the printing chamber 16. During switching from the second paper roll RP2 to the first paper roll RP1, the sheet ST of the second paper roll RP2 is rewound from the printing chamber 16 to the second paper roll RP2, and the sheet ST of the first paper roll RP1 is unwound from the first paper roll RP1 to the printing chamber 16. The operation of switching the paper rolls is performed automatically by a control device of the printer 11.

Figure 2A:
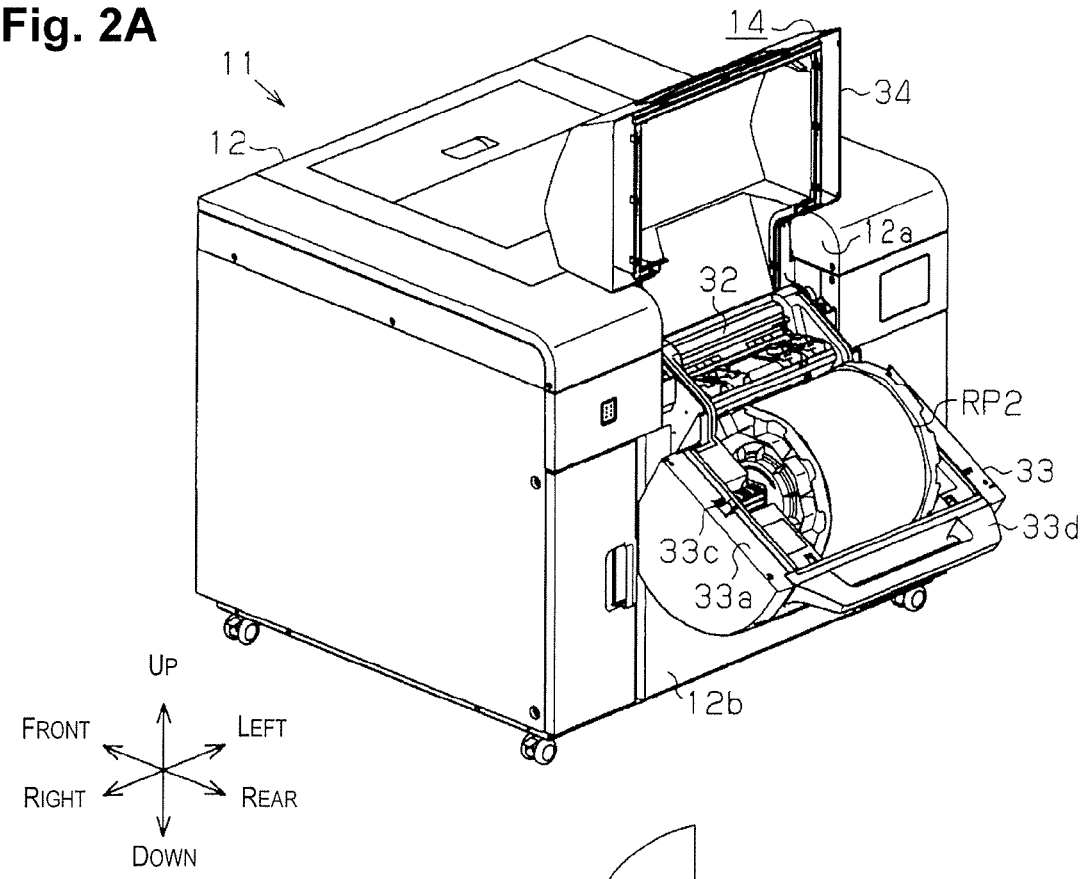
FIG. 2A is a perspective view showing the printer when the cover body of the second paper roll accommodating part is open.
Figure 2B:
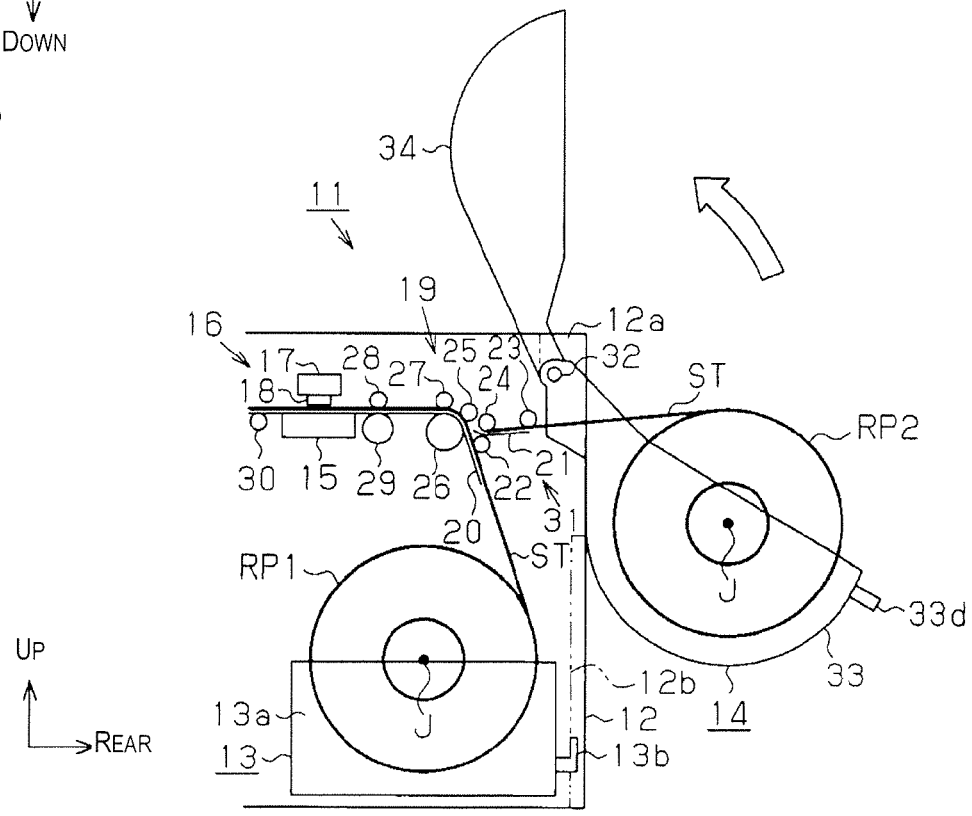
FIG. 2B is a rough structural view showing the printer in the state shown in FIG. 2A.

As shown in FIG. 2, the second paper roll accommodating part 14 is composed of an accommodating body 33 which is a receiving part for receiving the second paper roll RP2, and a cover body 34 which is a lid part for covering the accommodating body 33 by fitting with the accommodating body 33. The cover body 34 and the accommodating body 33 fit with each other, thereby forming an accommodating space for accommodating the second paper roll RP2 in the second paper roll accommodating part 14. The accommodating body 33 and the cover body 34 are each attached to the shaft 32. The accommodating body 33 and the cover body 34 thereby rotate in the up-down direction about the shaft 32.

The accommodating body 33 opens upward, and a top surface 33*a* thereof is provided so as to tilt downward toward the rear from the shaft 32. A support part 33*c* for supporting the roll rotation shaft J of the second paper roll RP2 is also provided at the center position in the front-rear direction of the accommodating body 33 by forming a notch extending downward from the top surface 33*a*. A U-shaped handle part 33*d* extending to the rear is also provided at the rear end of the accommodating body 33. In the second paper roll RP2, the sheet ST is conveyed to the roller 23 via a through-hole which passes through in the front-rear direction at a site in front of the accommodating body 33.

In the state in which the second paper roll RP2 is accommodated in the accommodating body 33, the upper portion of the second paper roll RP2 protrudes upward past the top surface 33*a*.

The cover body 34 rotates in relation to the accommodating body 33 between a closed position (see FIG. 1A) in which the cover body 34 and the accommodating body 33 are fitted with each other, and an open position (see FIG. 2A) in which the cover body 34 is moved upward in relation to the accommodating body 33.

In the second paper roll accommodating part 14 such as described above, the user replaces the second paper roll RP2 by opening the cover body 34 when the second paper roll accommodating part 14 is at the first rotation position. Specifically, in a case in which the second paper roll RP2 is replaced in a state in which the sheet ST of the second paper roll RP2 is conveyed to the printing chamber 16, i.e., in a state in which the second paper roll RP2 can be printed, the sheet ST of the second paper roll RP2 is rewound onto the second paper roll RP2. The second paper roll RP2 is then replaced after the cover body 34 has been moved to the open position.

In a state in which the sheet ST of the first paper roll RP1 is conveyed to the printing chamber 16, i.e., in a state in which the first paper roll RP1 can be printed, since the second paper roll RP2 has already been rewound, the second paper roll RP2 is replaced without the rewinding operation being performed for the second paper roll RP2. In such a case of replacing the second paper roll RP2, no rewinding of the first paper roll RP1 is performed, unlike in the conventional recording device 100 shown in FIG. 6.

The operation of replacing the first paper roll RP1 will next be described with reference to FIGS. 3 and 4.

Figure 3A:
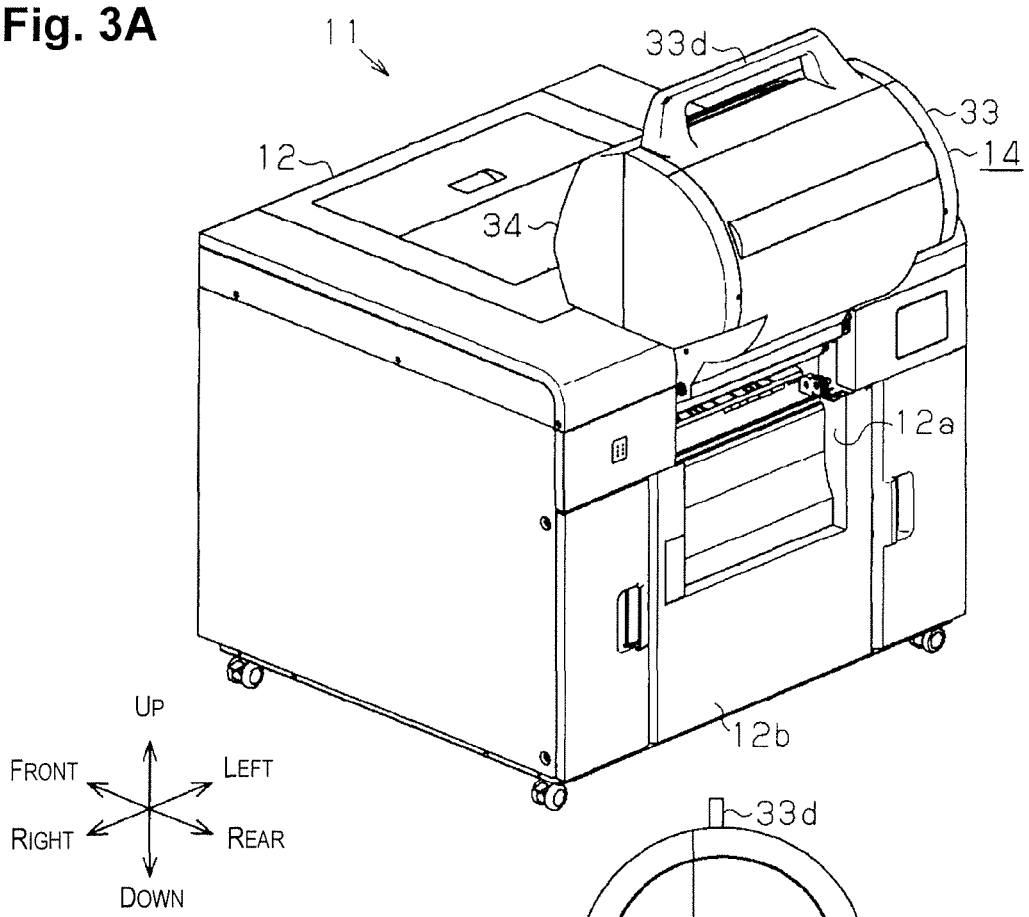
FIG. 3A is a perspective view showing the printer when the second paper roll accommodating part is at the second rotation position.

As shown in FIG. 3A, when replacing the first paper roll RP1, the user grasps the handle part 33*d* of the second paper roll accommodating part 14 at the first rotation position and rotates the second paper roll accommodating part 14 upward. The second paper roll accommodating part 14 thereby moves from the first rotation position to a position (hereinafter referred to as the "second rotation position") higher than the device body 12 of the first paper roll accommodating part 13. In other words, the second paper roll accommodating part 14 moves to a position which is clear of the second slide position. The second paper roll accommodating part 14 thereby no longer interferes with the second slide position when the second paper roll accommodating part 14 is at the second rotation position.

Figure 3B:
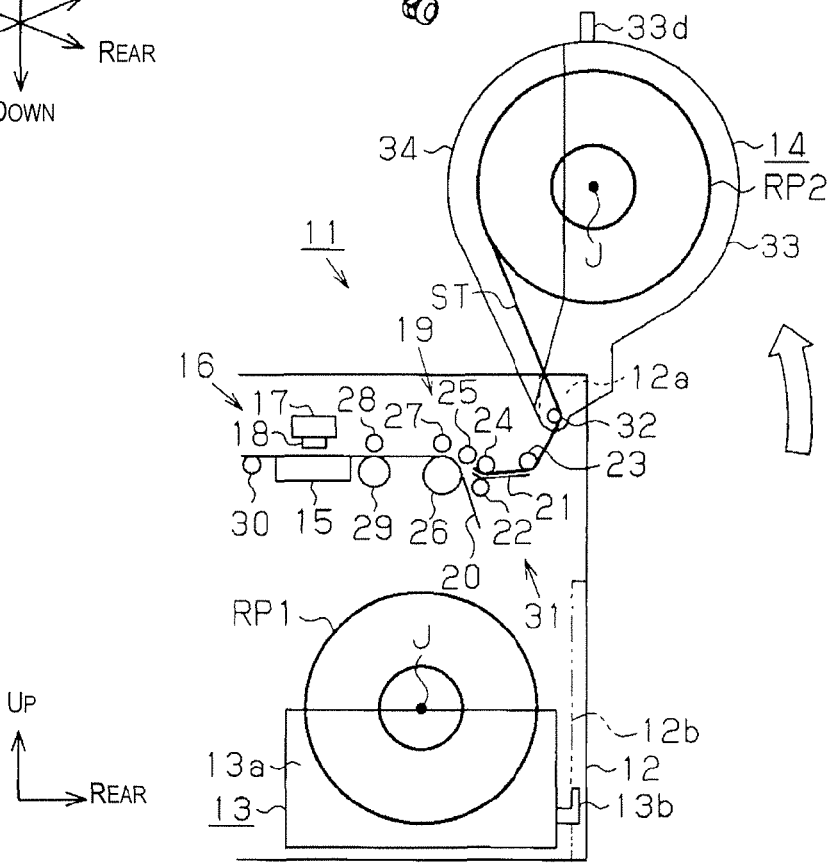
FIG. 3B is a rough structural view showing the printer in the state shown in FIG. 3A.

As shown in FIG. 3B, in a case in which the first paper roll RP1 is in a printable state, the sheet ST of the first paper roll RP1 is rewound by the rollers 22 and 25 through 30 during replacement of the first paper roll RP1. After rewinding of the sheet ST of the first paper roll RP1 is completed, the user rotates the second paper roll accommodating part 14 at the first rotation position toward the second rotation position. The second paper roll RP2 is not in a printable state, and has therefore already been rewound from the printing chamber 16.

In a case in which the second paper roll RP2 is in a printable state, the sheet ST of the second paper roll RP2 is rewound by the rollers 23, 24 during replacement of the first paper roll RP1. At this time, rewinding of the second paper roll RP2 is performed so as to adjust the distance of the sheet ST of the second paper roll RP2 to the printing chamber 16, which changes as the second paper roll accommodating part 14 moves from the first rotation position to the second rotation position. The first paper roll RP1 is not in a printable state, and has therefore already been rewound from the printing chamber 16.

Figure 4A:
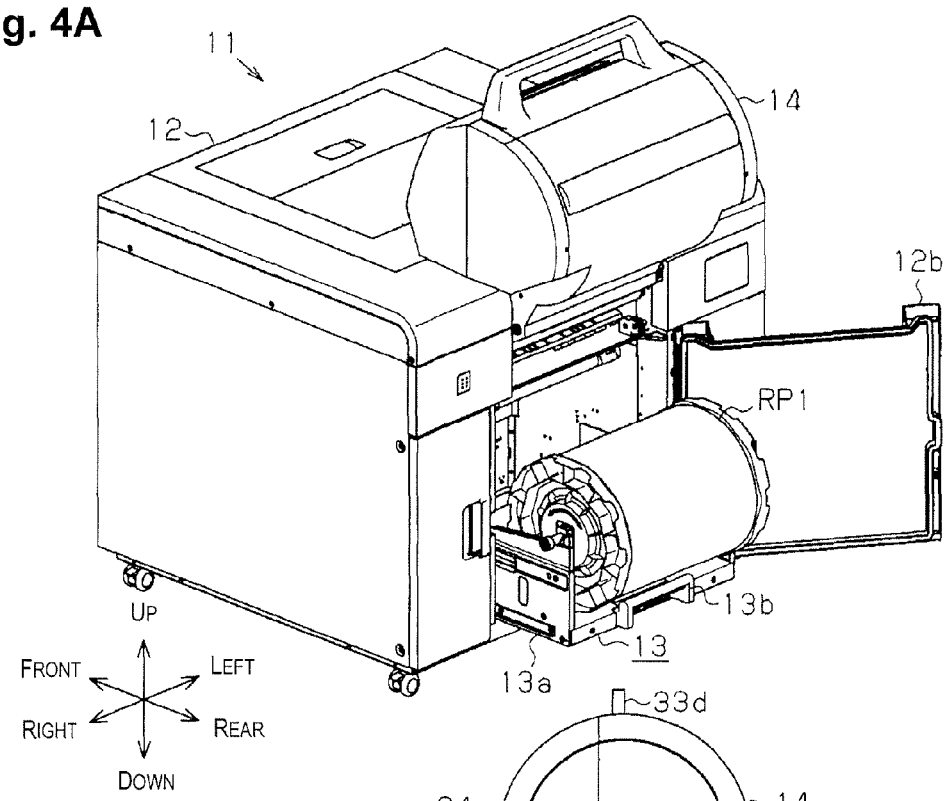
FIG. 4A is a perspective view showing the printer when the first paper roll accommodating part is at the second slide position.
Figure 4B:
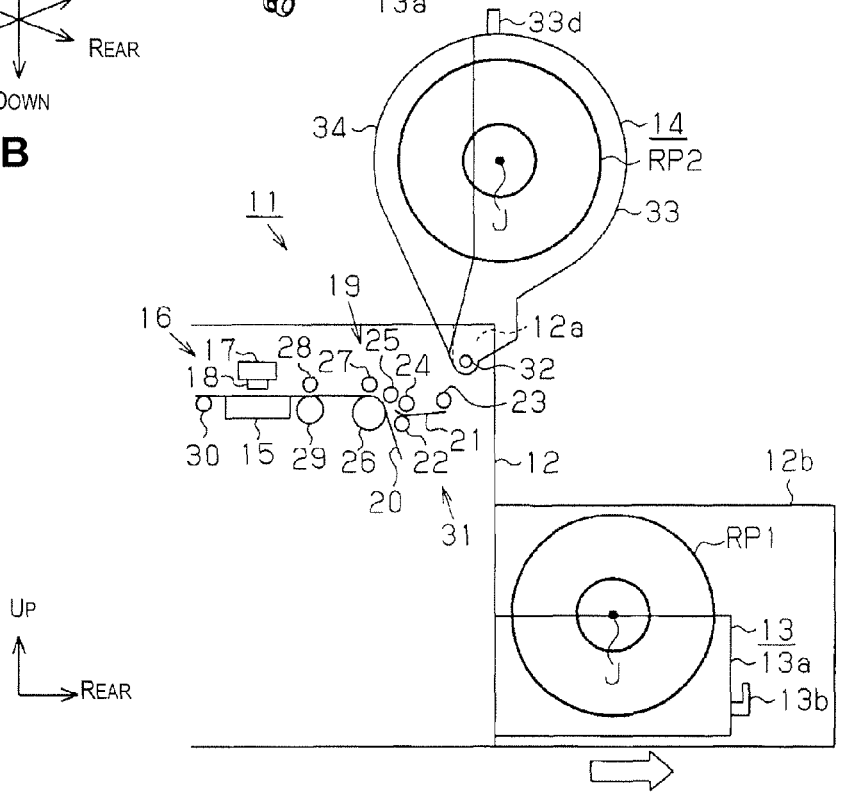
FIG. 4B is a rough structural view showing the printer in the state shown in FIG. 4A.

As shown in FIG. 4, the user pulls out the first paper roll accommodating part 13 toward the second slide position after opening the door 12*b*. The user then replaces the first paper roll RP1. After replacing the first paper roll RP1, the user moves the first paper roll accommodating part 13 to the first slide position by sliding the first paper roll accommodating part 13 forward, and the user then closes the door 12*b*. The user then returns the second paper roll accommodating part 14 from the second rotation position to the first rotation position. The sheet ST of the first paper roll RP1 or second paper roll RP2 is then unwound to the printing chamber 16.

The following effects can be obtained through the embodiment described above.

(1) The first paper roll accommodating part 13 is provided inside the device body 12, and the second paper roll accommodating part 14 is provided outside the device body 12 and attached to the device body 12. The degree of freedom of the placement of the second paper roll accommodating part 14 is thereby increased relative to a configuration in which the first paper roll accommodating part 13 and the second paper roll accommodating part 14 are both provided inside the device body 12. The first paper roll accommodating part 13 and the second paper roll accommodating part 14 can therefore be arranged so that the distance between the recording head 18 and each of the first paper roll accommodating part 13 and the second paper roll accommodating part 14 is reduced. Reductions in the precision of conveyance of the paper rolls by the conveyance mechanism 19 can thereby be suppressed, and the time taken to rewind the first paper roll RP1 or second paper roll RP2 during paper roll switching or paper roll replacement can be reduced.

(2) The first rotation position of the second paper roll accommodating part 14 interferes with the second slide position of the first paper roll accommodating part 13. Consequently, the size of the printer 11 in the up-down direction can be reduced relative to a configuration in which the first rotation position of the second paper roll accommodating part is disposed higher than the second slide position.

Replacement of the first paper roll RP1, particularly the pulling out of the first paper roll accommodating part 13, is difficult in a configuration in which the first rotation position of the second paper roll accommodating part 14 interferes with the second slide position of the first paper roll accommodating part 13. A configuration in which the second paper roll accommodating part can be detached from the device body is therefore possible as a method for replacing the first paper roll RP1. Specifically, after the second paper roll accommodating part is removed from the device body and the second paper roll accommodating part is placed on a mounting stage, the first paper roll accommodating part is moved to the second slide position and the first paper roll is replaced. Through this configuration, since the second paper roll accommodating part no longer interferes when the first paper roll accommodating part is pulled out, the first paper roll accommodating part can be easily pulled out.

However, the configuration described above in which the second paper roll accommodating part can be detached from the device body involves the operation of placing the second paper roll accommodating part on the mounting stage, and the operation for replacing the first paper roll is complex. In the present embodiment, however, replacement of the first paper roll RP1 only involves rotating the second paper roll accommodating part 14 to the second rotation position, and the operation of placing the second paper roll accommodating part 14 on the mounting stage is omitted. The complexity of the operation for replacing the first paper roll RP1 can therefore be minimized.

Moreover, in the configuration described above in which the second paper roll accommodating part can be detached from the device body, since the user carries the second paper roll accommodating part to the mounting stage, the user must bear the full weight of the second paper roll accommodating part. It is therefore difficult for the user to carry the second paper roll accommodating part to the mounting stage. In the present embodiment, however, since the second paper roll accommodating part 14 is capable of rotating about the shaft 32, there is no need for the user to bear the full weight of the second paper roll accommodating part 14. The user can therefore easily move the second paper roll accommodating part 14.

(3) In a state in which the second paper roll accommodating part 14 is at the first rotation position, the top end part of the second paper roll accommodating part 14 is positioned lower than the top end part of the device body 12. The size of the printer 11 in the up-down direction can thereby be reduced relative to a configuration in which the second paper roll accommodating part 14 protrudes upward past the top end part of the device body 12.

(4) Since the accommodating body 33 and the cover body 34 rotate about the same shaft 32, the configuration of the second paper roll accommodating part 14 can be simplified relative to a configuration in which a shaft for rotating the accommodating body 33 and a shaft for rotating the cover body 34 are provided as separate members.

In the case of replacing the second paper roll RP2, the user works from a position to the rear of the second paper roll accommodating part 14. In a case in which the cover body 34 is configured so as to open from front to rear, when the cover body 34 is moved to the open position during the operation described above, the cover body 34 is then positioned to the rear of the second paper roll accommodating part 14, and is positioned directly in front of the user. Consequently, the second paper roll RP2 is difficult to replace with the cover body 34 in this position.

In the present embodiment, however, since the second paper roll RP2 is disposed further to the rear than the shaft 32, and the cover body 34 opens from the rear toward the front, the abovementioned operation by the user is unobstructed even when the cover body 34 has been moved to the open position. The user can therefore easily perform the operation of replacing the second paper roll RP2.

(5) Since the paper roll loading capacity of the second paper roll accommodating part 14 is smaller than the paper roll loading capacity of the first paper roll accommodating part 13, a user can easily rotate the second paper roll accommodating part 14.

Since the second paper roll accommodating part 14 is also formed so that the width of the sheet ST that can be accommodated therein is smaller than the width of the sheet ST that can be accommodated in the first paper roll accommodating part 13, the size of the second paper roll accommodating part 14 can be reduced. The weight of the second paper roll accommodating part 14 before the second paper roll RP2 is accommodated can therefore be reduced.

(6) The shaft 32 about which the second paper roll accommodating part 14 rotates is provided in the vicinity of the roller 23 which constitutes a portion of the conveyance path, and the change in the distance between the second paper roll RP2 and the roller 23 before and after rotation of the second paper roll accommodating part 14 is thereby reduced. As a result, it is possible to reduce the amount of change in the length of the sheet ST unwound toward the roller 23 from the second paper roll RP2, caused by the rotation of the second paper roll accommodating part 14. It is thereby possible to reduce the amount of time needed to adjust the length of the sheet ST from the second paper roll RP2 to the roller 23, the length of the sheet ST occurring in conjunction with the rotation of the second paper roll accommodating part 14. As a result, it is possible to reduce the time taken for the printer 11 to return to a state in which printing is possible after the second paper roll RP2 in the second paper roll accommodating part 14 is replaced.

Since the distance between the second paper roll RP2 and the roller 23 is also reduced, a state in which the sheet ST unwound from the second paper roll RP2 is held by the roller 23 can easily be maintained. The sheet ST is thereby less prone to separate from the roller 23 when the second paper roll accommodating part 14 is rotated.

(7) Since the shaft 32 is provided above and to the rear of the device body 12, the second paper roll accommodating part 14 can be positioned higher than the top end part of the device body 12. As a result, the rotation range of the second paper roll accommodating part 14 can be increased relative to a configuration in which the shaft is provided in the center position or a lower position in the up-down direction of the device body.

Since the open position of the cover body 34 can also be positioned higher than the top end part of the device body 12, the rotation range of the cover body 34 can also be increased. The second paper roll RP2 can thereby be easily replaced in a state in which the cover body 34 is at the open position.

(8) Since the user grasps the handle part 33*d* at the rear end of the accommodating body 33 of the second paper roll accommodating part 14 to rotate the second paper roll accommodating part 14, the user can easily perform the rotation operation described above.

Since the handle part 33*d* is provided on the accommodating body 33 side, the user can rotate the second paper roll accommodating part 14 more stably than with a configuration in which the handle 33*d* is provided to the side of the cover body 34.

(9) In a state in which the second paper roll RP2 is accommodated in the accommodating body 33, a portion of the second paper roll RP2 protrudes upward past the top surface 33*a* of the accommodating body 33. The amount of upward movement of the second paper roll RP2 from the accommodating body 33 when the second paper roll RP2 is removed from the accommodating body 33 is thereby reduced relative to a configuration in which the top end part of the second paper roll is in the same position in the up-down direction as the top surface 33*a* of the accommodating body 33, or is positioned lower than the top surface 33*a*. Consequently, the second paper roll RP2 can easily be put into and taken out of the accommodating body 33.

(10) Since the top surface 33*a* of the accommodating body 33 tilts downward and to the rear from the shaft 32, it is possible to reduce the amount of movement of the second paper roll RP2 in the vertical direction when the second paper roll RP2 is removed from the accommodating body 33. The second paper roll RP2 can therefore be easily removed from the accommodating body 33.

(11) Since a configuration is adopted in which the distance from the first paper roll RP1 to the roller 22 and the distance from the second paper roll RP2 to the roller 24 are substantially equal, the distance from the second paper roll RP2 to the roller 24 is reduced. Consequently, reductions in the precision of conveyance of the paper rolls by the conveyance mechanism 19 can be suppressed, and the time taken to rewind the first paper roll RP1 or second paper roll RP2 during paper roll switching or paper roll replacement can be reduced.

(12) Since the handle part 13*b* is provided to the accommodating body 13*a* of the first paper roll accommodating part 13, the user can easily pull the first paper roll accommodating part 13 inside the device body 12 out to the rear past the device body 12. The user can therefore easily replace the first paper roll RP1.

(13) In the conventional recording device 100 shown in FIG. 6, the upper paper roll accommodating part is also pulled out to the rear from the device body after the lower paper roll RPD is rewound during replacement of the upper paper roll RPU. The recording device 100 therefore takes time to return to the movable state after replacement of the upper paper roll RPU.

In the present embodiment, however, since the first paper roll RP1 is not rewound during replacement of the second paper roll RP2, it is possible to reduce the time taken for the printer 11 to return to the movable state after replacement of the second paper roll RP2.

(14) Since the second paper roll accommodating part 14 is disposed in a position at which the second paper roll accommodating part 14 interferes with the opening and closing position of the door 12*b* in a state in which the printer 11 is capable of printing, the door 12*b* in the movable state can be prevented from inadvertently opening.

(15) In a state in which the printer 11 is capable of printing, the second paper roll accommodating part 14 is disposed at the first rotation position, and the second paper roll accommodating part 14 is thereby disposed lower than the top end part of the device body 12. A plurality of printers 11 can therefore be loaded in the up-down direction. In a case in which a plurality of printers 11 is thus provided, the printers 11 can be arranged in a small space.

Second Embodiment

A second embodiment of the present invention will next be described based on FIG. 5. The present embodiment differs from the first embodiment with respect to the placement of the second paper roll accommodating part in relation to the device body. The following description will concentrate on the aspects which differ from the first embodiment. The same reference symbols are used to refer to members that are the same as members of the first embodiment or that correspond to members of the first embodiment, and no redundant description of such members will be given.

Figures 5A, 5B, 5C:
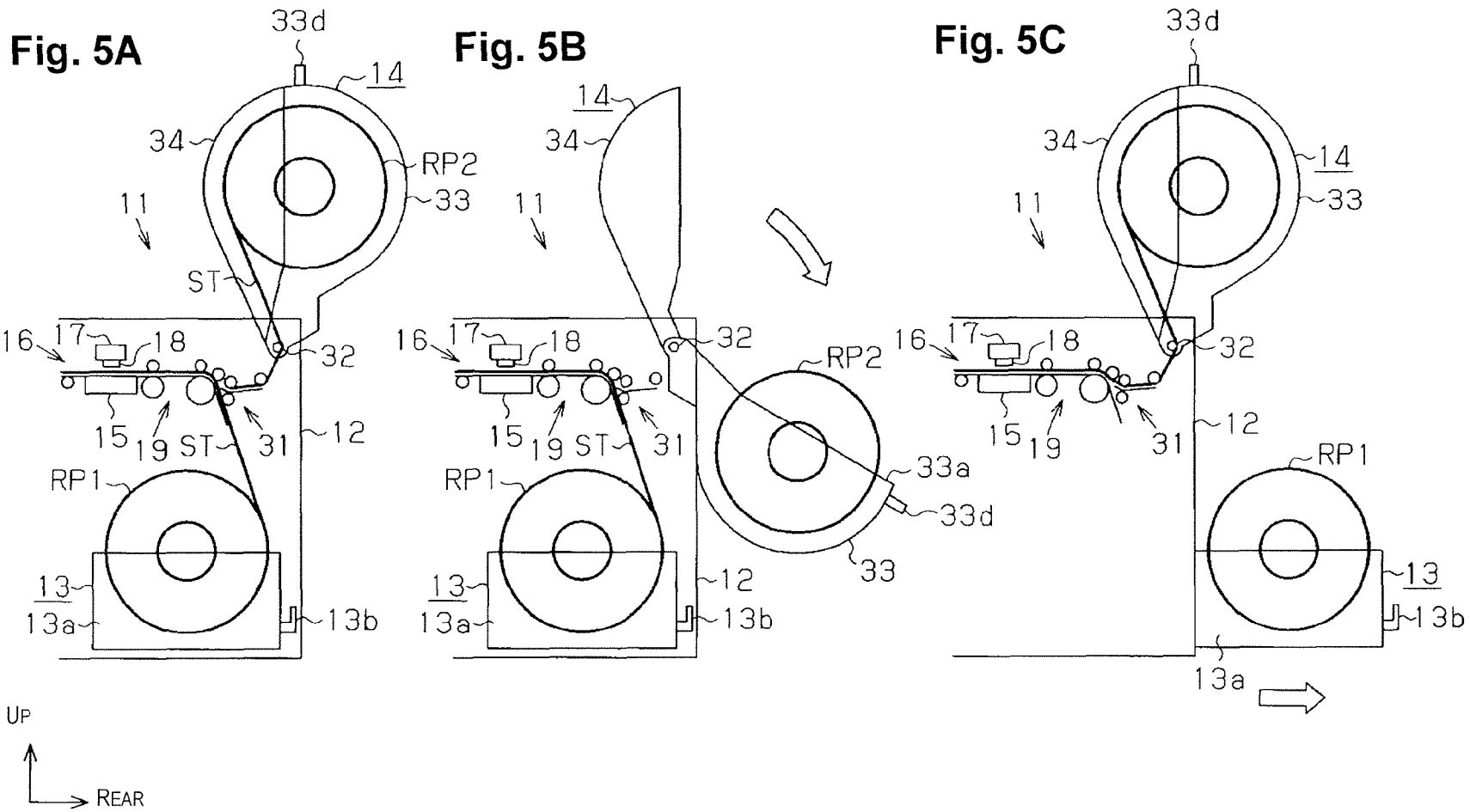
FIGS. 5A through 5C are rough structural views showing the printer according to a second embodiment.

As shown in FIG. 5A, the second paper roll accommodating part 14 is disposed so as to be higher than the top end part of the device body 12 in a state in which the printer 11 is capable of printing. In other words, the second paper roll accommodating part 14 is disposed higher than the second slide position of the first paper roll accommodating part 13.

As shown in FIG. 5B, when replacing the second paper roll RP2, a user rotates the accommodating body 33 downward from the closed position at which the accommodating body 33 and the cover body 34 fit with each other, and moves the accommodating body 33 to the open position at which the accommodating body 33 is separated from the cover body 34. In this state, the top surface 33*a* of the accommodating body 33 is tilted downward and to the rear from the shaft 32. In this state, the second paper roll RP2 is replaced.

As shown in FIG. 5C, when replacing the first paper roll RP1, the user opens the door 12*b* (not shown in FIG. 5) from the state of the printer 11 shown in FIG. 5A, and pulls out the first paper roll accommodating part 13 so that the first paper roll accommodating part 13 reaches the second slide position. In this state, the first paper roll RP1 is replaced.

The effects described below can be obtained by the embodiment described above, in addition to effects (1) and (4) through (13) of the first embodiment.

(16) Since the second paper roll accommodating part 14 is disposed higher than the second slide position of the first paper roll accommodating part 13 in a state in which the printer 11 is capable of printing, the operation of replacing the paper roll can be more easily performed than in the first embodiment when the first paper roll RP1 is replaced. In other words, the operation of rotating the second paper roll accommodating part 14 upward can be omitted in the present embodiment.

The embodiments described above may also be modified into other embodiments such as those described below.

In the first embodiment, the top end part of the second paper roll accommodating part 14 may be disposed in the same place in the up-down direction as the top end part of the device body 12 in a case in which the second paper roll accommodating part 14 is at the first rotation position.

In the embodiments, the paper roll loading capacities of the first paper roll accommodating part 13 and second paper roll accommodating part 14 may be the same. The second paper roll accommodating part 14 may also be provided so that the paper roll loading capacity thereof is greater than that of the first paper roll accommodating part 13.

In the embodiments, a rotation shaft about which the cover body 34 opens and closes may be provided separately from the shaft 32. In this case, a shaft may be attached above the rear end of the accommodating body 33, for example, and the cover body 34 may be attached to the shaft so that the cover body 34 can open and close about the shaft.

In the embodiments, a wall part constituting a portion of the rear surface of the device body 12 instead of the door 12*b* may be formed integrally with the first paper roll accommodating part 13. In this case, the operation of opening and closing the door 12*b* during replacement of the first paper roll RP1 is omitted. In other words, the first paper roll RP1 is placed behind the device body 12 merely by pulling the first paper roll accommodating part 13 out to the rear past the device body 12.

In the embodiments, the conveyance mechanism is formed by the rollers 22 through 30, but the number of rollers may be reduced insofar as the first paper roll RP1 and second paper roll RP2 can be conveyed to the printing chamber 16.

In the embodiments, an inkjet printer 11 is described as a specific example of the recording device, but this configuration is not limiting, and a configuration may be adopted in which the first paper roll accommodating part and the second paper roll accommodating part of the embodiments described above are provided to an electrophotographic or other type of printer, a FAX device, a copy device, or a multi-function machine or the like provided with these multiple functions. A recording device may also be used which ejects or discharges a liquid other than ink. The present invention may be used in various liquid ejection devices provided with a liquid ejection head or the like for discharging minute droplets. The liquid may be any material which can be ejected by the liquid ejection device. For example, the liquid is preferably in a state in which the material thereof is in the liquid phase, and includes not only fluids and materials that are liquid in one state thereof, such as high or low-viscosity liquids, sol/gel solutions, and other inorganic solvents, organic solvents, solutions, liquid resins, and liquid metals (metal liquids), but liquids in which particles of functional material composed of pigments, metal particles, and other solids are dissolved, dispersed, or mixed in a solvent. Ink, liquid crystal, or the like such as described in the embodiments above are cited as typical examples of the liquid. The term "ink" includes common water-based ink, oil-based ink, gel ink, hot-melt ink, and various other liquid compositions. Specific examples of the liquid ejection device may include liquid ejection devices for ejecting liquid which includes electrode material, color material, or other material in dispersed or dissolved form for use in such applications as manufacturing liquid crystal displays, EL (electroluminescent) displays, surface-emitting displays, and color filters; liquid ejection devices for ejecting biological organic materials used to manufacture biochips; liquid ejection devices used as precision pipettes for ejecting liquids as test samples; and printing devices, microdispensers, and the like. It is also possible to use liquid ejection devices for ejecting lubricating oil with pinpoint precision onto a clock, camera, or other precision machine; liquid ejection devices for ejecting UV-curing resin or other transparent resin liquids onto a substrate to form micro hemispherical lenses (optical lenses) used in an optical communication device or the like; and liquid ejection devices for ejecting acid or alkaline etching solution for etching a substrate or the like. The present invention may be provided to any of these types of liquid ejection devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a device body forming a chassis;

a recording head configured to record on a sheet unwound from a first paper roll or a second paper roll, the recording head being provided inside the device body;

a first paper roll accommodating part including an accommodating body that defines a space so that at least a part of the first paper roll is placed within the space;

a second paper roll accommodating part configured to accommodate the second paper roll; and a conveyance mechanism configured to convey a sheet unwound from the first paper roll or a sheet unwound from the second paper roll to the recording head, the first paper roll accommodating part being provided inside the device body, and at least the accommodating body being configured to be pulled to the outside of the device body by being slid in relation to the device body along a linear direction, and the second paper roll accommodating part being provided outside the device body and attached to the device body, and the second paper roll accommodating part being configured to be rotated in relation to the device body independently of sliding of the first paper roll accommodating part, wherein a first slide position at which the first paper roll accommodating part is accommodated inside the device body, and a second slide position at which the first paper roll accommodating part is pulled to the outside of the device body can be selected as the position of the first paper roll accommodating part with respect to the device body, wherein a first rotation position at which the second paper roll accommodating part interferes with the first paper roll accommodating part when the first paper roll accommodating part is being slid to the second slide position, and a second rotation position at which the second paper roll accommodating part does not interfere with the first paper roll accommodating part when the first paper roll accommodating part is at the second slide position can be selected as the position of the second paper roll accommodating part with respect to the device body, and wherein the accommodating body has a box shape.

2. The recording device according to claim 1, wherein a top end part of the second paper roll accommodating part is at the same height as a top end part of the device body or is positioned lower than the top end part of the device body when the second paper roll accommodating part is at the first rotation position.

3. The recording device according to claim 1, further comprising a rotation shaft attached to the device body and configured to cause the second paper roll accommodating part to rotate, the second paper roll accommodating part including a receiving part configured to receive the second paper roll, and a lid part configured to cover an open side of the receiving part and thereby accommodating the second paper roll in cooperation with the receiving part, each of the receiving part and the lid part being attached to, and rotating about, the rotation shaft.

4. The recording device according to claim 1, wherein the paper roll loading capacity of the second paper roll accommodating part is smaller than the paper roll loading capacity of the first paper roll accommodating part.

5. The recording device according to claim 1, wherein the first paper roll accommodating part is configured to be pulled rearwardly to the outside of the device body so that the first paper roll accommodated in the first paper roll accommodating part is placed behind the device body.

6. The recording device according to claim 1, wherein the chassis of the device body has a rectangular box shape.

* * * * *